US006858099B2

(12) United States Patent
Ishii et al.

(10) Patent No.: US 6,858,099 B2
(45) Date of Patent: Feb. 22, 2005

(54) STEEL MATERIAL PRODUCTION METHOD

(75) Inventors: Kazuo Ishii, Wako (JP); Yoshinari Okada, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 132 days.

(21) Appl. No.: 10/297,198

(22) PCT Filed: Apr. 4, 2002

(86) PCT No.: PCT/JP02/03403

§ 371 (c)(1),
(2), (4) Date: Dec. 4, 2002

(87) PCT Pub. No.: WO02/083959

PCT Pub. Date: Oct. 24, 2002

(65) Prior Publication Data

US 2004/0003869 A1 Jan. 8, 2004

(30) Foreign Application Priority Data

Apr. 6, 2001 (JP) ..... 2001-108798

(51) Int. Cl.[7] ..... C22C 38/14; C21D 8/00; C22F 8/26

(52) U.S. Cl. ..... 148/318; 148/326; 148/328; 148/652; 148/651; 148/230; 148/228

(58) Field of Search ..... 148/318, 328, 148/326, 651, 652, 230, 228

(56) References Cited

U.S. PATENT DOCUMENTS 6,309,474 B1 * 10/2001 Yagasaki ..... 148/230

FOREIGN PATENT DOCUMENTS

| | | |
|---|---|---|
| JP | 55-050424 | 4/1980 |
| JP | 61-113716 | 5/1986 |
| JP | 61-210156 | 9/1986 |
| JP | 62-156250 | 7/1987 |
| JP | 62-192528 | 8/1987 |
| JP | 62-224665 | 10/1987 |
| JP | 02-154834 | 6/1990 |
| JP | 2000-087214 | 3/2000 |

* cited by examiner

*Primary Examiner*—Deborah Yee
(74) *Attorney, Agent, or Firm*—Arent Fox, PLLC

(57) ABSTRACT

A method for producing a steel material having a high fatigue strength and given a uniform residual stress by a rapid treatment. A marageing steel is subjected to a cold plastic working to have a predetermined dimension, to a solution treatment for 60 minutes or more at a temperature of 750 to 800° C., and to an aging.

12 Claims, 3 Drawing Sheets

STEEL MATERIAL PRODUCTION METHOD

BACKGROUND OF THE INVENTION

1. Field of the Invention

The present invention relates to a method for producing a steel material having a high fatigue strength and can be suitably used in power transmission in automobiles and industrial machines.

2. Description of the Related Art

In order to improve fatigue strength of a material such as marageing steel, solution heat treatment, aging treatment, and nitriding treatment are generally applied. A method for imparting further higher fatigue strength is disclosed in Japanese Patent Application Laid-Open (JP-A) No. HEI 2-154834. According to this method, after surface hardening treatment such as the nitriding, a shot-peening treatment is applied on the surface, and thereby compressive residual stress is imparted, resulting in a steel material having high fatigue strength.

However, in the prior arts such as the method set forth in JP-A No. 2-154834, there are problems as follows.

1. Since it is difficult to spray hard particles uniformly on front and back surfaces, residual stress varies, resulting in inability to obtaining predetermined fatigue strength.

2. In order to make the residual stress uniform, the hard particles have to be uniformly sprayed while changing spraying position, resulting in a longer operation time.

3. Since irregularities are formed on the surface owing to the spraying of the hard particles, it is difficult to control surface roughness and surface properties (mirrored surface, buffer mark, twill line, etc.) with an intention of applying, for instance, a lubricant and so on.

SUMMARY OF THE INVENTION

The present invention is carried out with an intention to overcome such problems and it is an object thereof to provide a production method that can rapidly impair a steel material with uniform residual stress and can thereby produce a steel material having high fatigue strength.

Steel material is generally cold-rolled or cold-drawn to obtain a predetermined thickness or a predetermined wire diameter. Though residual stress generates in steel material at this time due to the rolling, it usually disappears due to later solution heat treatment. The present inventors have extensively researched while focusing on the residual stress. As a result, the inventors have found a steel material production method that does not remove the residual stress and can yield high fatigue strength. A steel material production method of the present invention comprises cold-plastic-working marageing steel to form a predetermined dimension; solution-heating at a temperature in a range of 750 to 800° C. for 60 minutes or more; and aging.

According to the present invention, the solution heat treatment is controlled at a temperature in the range of 750 to 800° C. and a processing time of 60 minutes or more, and thereby the marageing steel can be homogenized in its material without removing compressive residual stress given during the cold plastic working. Accordingly, in the steel material, uniform and high residual stress can be retained on a surface thereof and superior toughness is obtained by carrying out a series of processes without carrying out a process for impairing the residual stress such as a shot peening that has so far been necessary. As a result, a steel material having high fatigue strength can be stably produced. Furthermore, since the surface properties can also be freely controlled, for instance, in the case of a steel strip, in view of necessity of lubrication, mirror finishing or a process for producing twill lines can be easily applied.

DESCRIPTION OF THE PREFERRED EMBODIMENTS

Although any one of marageing steels can be used as a material for the present invention, in the following embodiments, marageing steel having a composition shown in Table 1 is studied under the following conditions.

TABLE 1

| C | Si | Mn | P | S | Ni | Mo | Co | Al | Ti |
|---|---|---|---|---|---|---|---|---|---|
| ≦0.01 | ≦0.05 | ≦0.05 | ≦0.008 | ≦0.004 | 15~19 | 3~5.5 | 8~15 | 0.05~0.15 | 0.4~1.5 |

1. Conditions of Solution Heat Treatment

Figure 1:
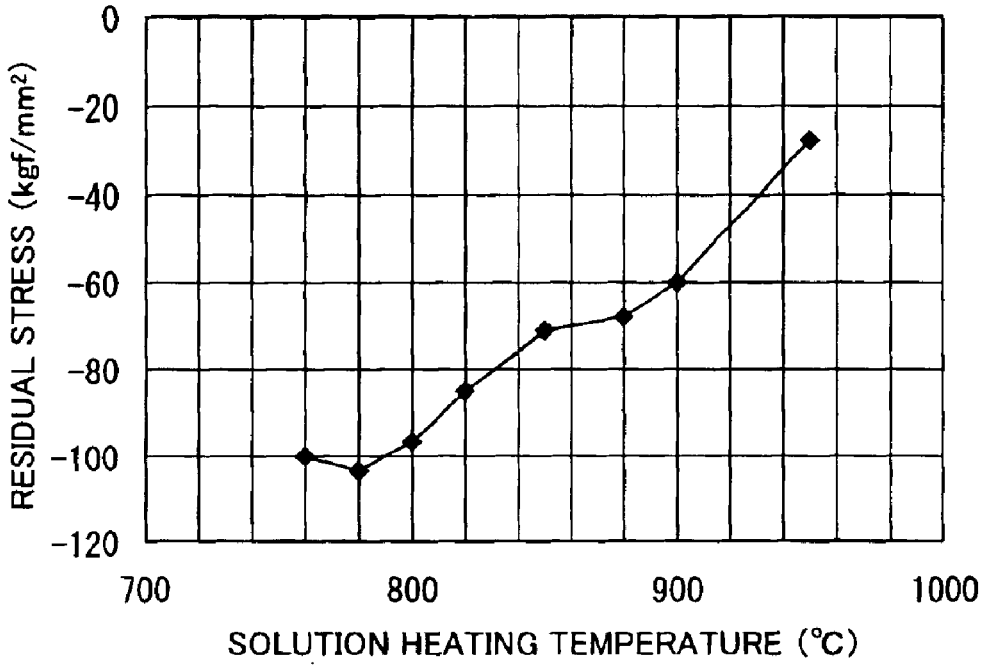
FIG. 1 is a diagram showing the relationship between residual stress and solution heating temperature.

JP-A No. 2-154834 discloses that the solution heat treatment can be preferably carried out at a temperature in the range of 800 to 850° C. However, in such a temperature region, since a metallographic structure is completely recrystallized, the compressive residual stress due to the cold plastic working disappears. Accordingly, first, an effect in that the solution heating temperature affects on the residual stress was experimentally studied. Marageing steel at a cold rolling rate of 40% was subjected to the solution heat treatment at different temperatures for a fixed time of 120 minutes, and then aging treatment and nitriding treatment were carried out. The compressive residual stress thereof was measured using X-ray, and the results are shown in FIG. 1. Here, the rolling rate denotes a ratio of a thickness change due to the rolling to an original plate thickness. As is obvious from FIG. 1, it was found that when the solution heating temperature exceeds 800° C., the residual stress rapidly decreases. Thus, it was found that the solution heat treatment has to be carried out at 800° C. or less in order to retain the residual stress given during the cold rolling.

Figure 2:
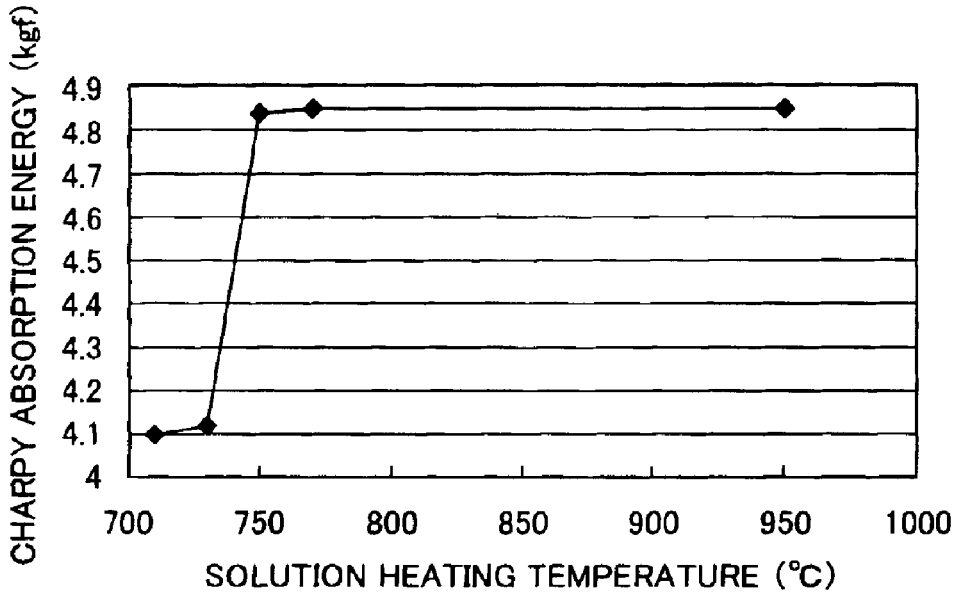
FIG. 2 is a diagram showing the relationship between Charpy absorbed energy and solution heating temperature.

Then, though it was found that the residual stress given during the cold rolling can be maintained when the solution heat treatment is carried out at 800° C. or less, when the solution heat treatment is carried out at too lower a temperature, deformation texture remains and the toughness is deteriorated during aging treatment. Accordingly, the marageing steel having a cold rolling rate of 40% was subjected to the solution heat treatment at different temperatures for a fixed time of 120 minutes, and then the aging treatment and the nitriding treatment were carried out. Obtained test pieces were subjected to Charpy tests. The results are shown in FIG. 2. As is apparent from FIG. 2, it was found that shock absorption energy decreases when the solution heating temperature is lower than 750° C. Generally when the toughness decreases, propagation speed of fatigue cracks becomes larger, resulting in the deterioration of the fatigue strength. As a result, when the solution heat treatment is carried out at a temperature lower than 750° C., an object of improving the fatigue strength cannot be attained. Therefore, the solution heating temperature in the present invention was limited to the range of 750 to 800° C.

Figure 3:
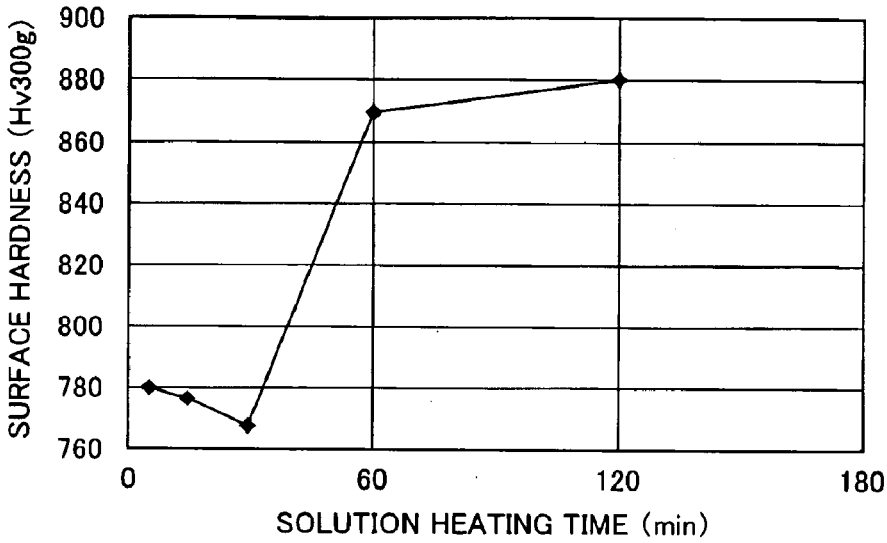
FIG. 3 is a diagram showing the relationship between surface hardness and solution heating time.

Furthermore, the solution heat treatment diffuses aging elements Ti, Al and Mo, and thereby the following aging treatment can be uniformly carried out. Accordingly, the longer the solution heating time, the more preferable the following aging and nitriding treatments. Therefore, the marageing steel having a cold rolling rate of 40% was subjected to the solution heat treatment at a temperature of 780° C. for 5 to 120 minutes, and then the aging treatment and the nitriding treatment were carried out. Obtained test pieces were subjected to surface hardness test. Thereby, the solution heating time necessary for obtaining sufficient surface hardness is clarified. The results thereof are shown in FIG. 3. As is obvious from FIG. 3, it was shown that the solution heating time of at least 60 minutes is necessary in order to obtain the sufficient surface hardness after the aging and nitriding treatments. Therefore, the solution heating time in the present invention was limited to 60 minutes or more.

2. Conditions of Aging Treatment

The aging treatment is finely precipitates intermetallic compounds of Ti, Al, Mo, etc., and thereby the marageing steel is hardened. When the aging temperature is lower or the aging time is shorter, unprecipitated dissolved elements remain. On the other hand, when the aging temperature is higher or the aging time is longer, the precipitates become coarser. Furthermore, when the nitriding treatment is carried out, Ti dissolved in the vicinity of the surface finely precipitates as TiN. Accordingly, in order to increase the surface hardness and to impair the surface residual stress during the nitriding treatment, it is very important to obtain a sub-aged state in which unprecipitated, that is, the dissolved Ti remains in the aging treatment. For this purpose, it is necessary for the aging temperature to be relatively low and for the aging time to be shorter.

Figure 4:
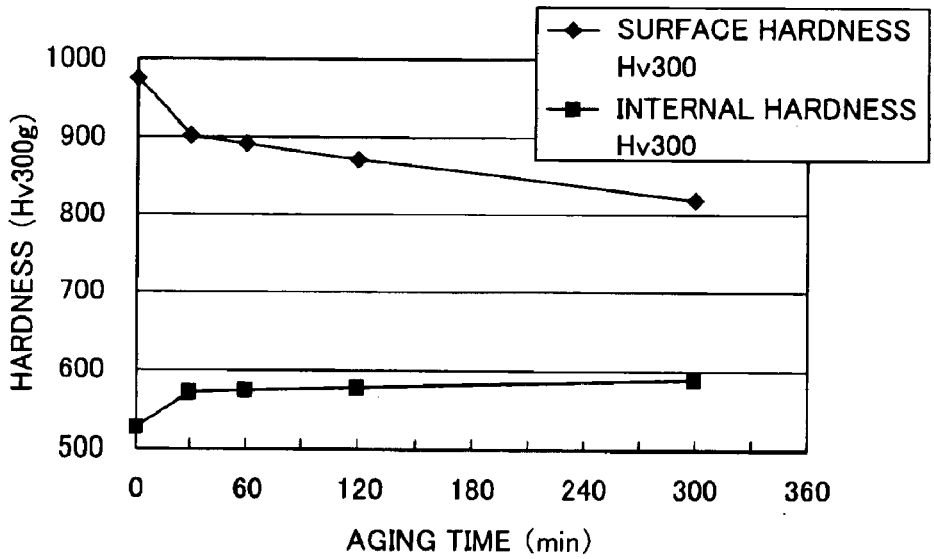
FIG. 4 is a diagram showing the relationship between hardness and aging time.

From the this point of view, the marageing steel having a cold rolling rate of 40% was subjected to the solution heat treatment, and then the aging treatments at various temperatures for various times and the nitriding treatment were carried out. Obtained test pieces were subjected to surface hardness tests. FIG. 4 shows an influence of the aging time on the surface and internal hardness at 480° C. As is obvious from FIG. 4, it was shown that at 480° C. and 300 minutes, the aging proceeds and the surface hardness becomes low. Accordingly, it was found that the aging temperature in the range of 480 to 500° C. and the aging time in the range of 30 to 120 minutes are the most preferable in order to maintain the surface hardness and to impair the residual stress.

The sub-aging under the conditions other than the above temperatures and times can also generate an effect similar to the above. However, when the temperature is set at a temperature lower than the above, an extremely long aging time is required, and when the temperature is higher than the above, the heating time must be strictly controlled within a short time, resulting in impracticability in production.

3. Conditions of Nitriding Treatment

As the nitriding treatment, salt bath nitriding, gas nitriding, plasma nitriding, etc., can be mentioned, and any one of the nitriding methods can be used in the present invention. However, the salt bath nitriding is not suitable for usage in which the fatigue strength is important, since it generates a nitride layer or a porous layer. In addition, the ion nitriding has difficulty in productivity. Accordingly, in the industrial nitriding with an aim in the fatigue strength like the present invention, the gas nitriding containing ammonia gas is the most preferable. In the case of the gas nitriding in which the fatigue strength is the primary object, when there is a hardness profile that shows a steep hardness gradient, the stress concentrates at an inflection point of the hardness and the inflection point becomes a starting point of fatigue destruction. Accordingly, it is important that the nitride layer not be formed on the surface as far as possible and a nitrogen diffusion layer be gradually formed from the surface and thereby a hardness gradient be made smooth.

Figure 5:
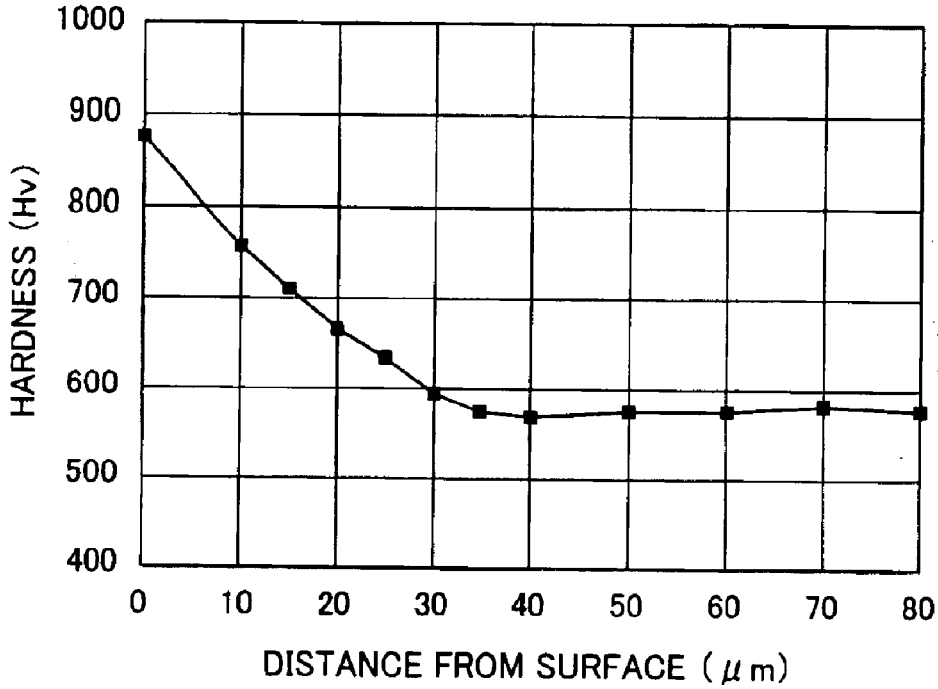
FIG. 5 is a diagram showing the relationship between hardness and distance from a surface.

From this point of view, the marageing steel having a cold rolling rate of 40% was subjected to the solution heat treatment, and then the aging treatment and the nitriding treatments under various nitriding conditions were carried out. Obtained test pieces were subjected to surface hardness test. As a result, it was found that the nitriding conditions which can obtain the optimum hardness profile are in the temperature range of 440 to 480° C. for 30 to 120 minutes. A typical hardness profile is shown in FIG. 5. It was found that by giving such a nitriding profile, the surface hardness can be increased and the surface residual stress can be further heightened, resulting in improving the fatigue strength.

4. Atmosphere of Solution Heat Treatment

As described above, in the case in which dissolved Ti is present in the vicinity of the surface, when the nitriding treatment is carried out, TiN precipitates, thereby causing surface hardening and improving the surface residual stress. However, in the solution heat treatment under general conditions, Ti in the marageing steel reacts with oxygen in the atmosphere so as to form $TiO_2$, resulting in a decrease of the dissolved Ti. As a result, when a concentration of Ti dissolved in the vicinity of the surface becomes lower than that of the inside thereof, the residual stress of the surface and that of the inside thereof become unbalanced by nitriding. Accordingly, the fatigue strength is not improved as much as expected. In order to avoid such a phenomenon, the concentration of Ti dissolved in the range which forms a hardened nitriding layer is set to be equal to or above a definite ratio with respect to an average concentration of the dissolved Ti so as to improve the surface residual stress and the fatigue stress. Under various atmospheres, the solution heat treatment was carried out on the marageing steels having a cold rolling rate of 40%, so that Ti concentration ratios thereof are different, and thereafter the aging and nitriding treatment were carried out. Obtained test pieces were subjected to the fatigue test. The results are shown in Table 2. The Ti concentration ratio was defined as follows.

(Ti concentration ratio)=(Ti concentration dissolved in the vicinity of the surface)/(averaged dissolved Ti concentration)

TABLE 2

| | Heating Condition | Atmosphere | Dissolving State of Ti | Ti Concentration Ratio | Improvement of Fatigue Strength |
|---|---|---|---|---|---|
| Sample 1 | 780° C. × 60 min | $N_2$ + 4% $H_2$ | Concentration of dissolved Ti in the vicinity of surface did not decrease. | 0.91 | Large |
| Sample 2 | 780° C. × 60 min | $N_2$ + 8% $H_2$ | Concentration of dissolved Ti in the vicinity of surface did not decrease. | 0.92 | Large |
| Sample 3 | 780° C. × 60 min | $N_2$ + LP gas | Ti precipitation generated inside. | 0.85 | Small |
| Sample 4 | 780° C. × 60 min | Ar | Concentration of dissolved Ti in the vicinity of surface decreased. | 0.70 | Small |
| Sample 5 | 780° C. × 60 min | $N_2$ (0.75 torr) | Concentration of dissolved Ti in the vicinity of surface decreased. | 0.87 | Small |
| Sample 6 | 780° C. × 60 min | $N_2$ ($10^{-4}$ torr) | Concentration of dissolved Ti in the vicinity of surface did not decrease. | 0.93 | Large |

As shown in Table 2, in Sample 3 that was solution-heated in an atmosphere of $N_2$ and LP gas, Ti precipitation generated inside thereof, resulting in inability to obtaining superior internal hardness. Furthermore, in Samples 4 and 5 that were solution-heated in an atmosphere of Ar or $N_2$ (0.75 Torr), high fatigue strength could not be obtained because of a decrease in the concentration of dissolved Ti in the vicinity of the surface. In these cases, the Ti concentration ratios were less than 0.9. Accordingly, in the present invention, it was found that high fatigue strength can be maintained when the Ti concentration ratio is 0.9 or more and that the solution heat treatment is preferably carried out in a vacuum of $10^{-4}$ Torr or less, more preferably of $10^{-5}$ Torr or less, or in a reductive atmosphere of hydrogen gas, in order to maintain such a fatigue strength improvement effect.

5. Bending Fatigue Test

Figure 6:
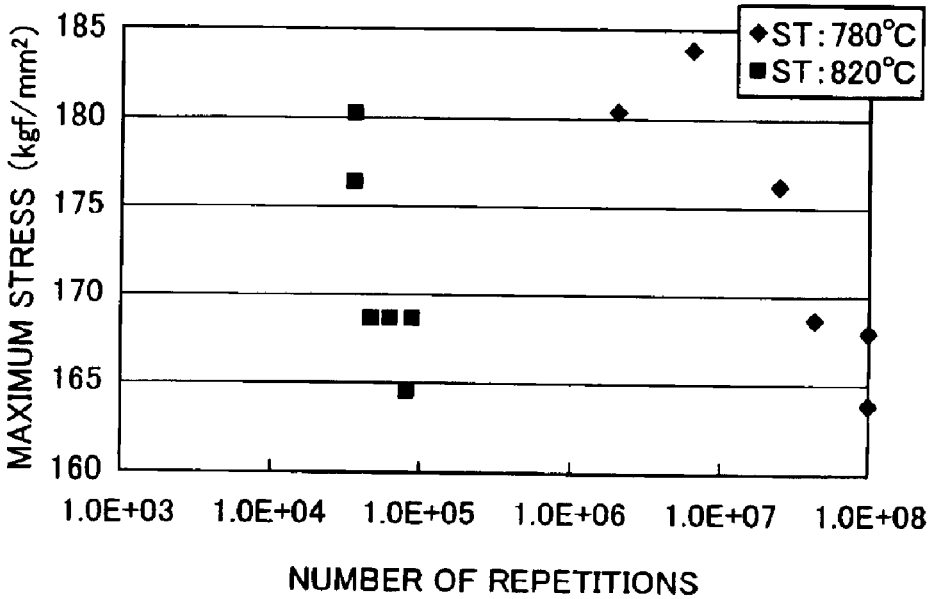
FIG. 6 is a diagram showing the relationship between the maximum stress and the number of repetitions.

Next, a steel strip of marageing steel cold-rolled having a rolling rate of 40% was solution-heated at 780° C. (embodiment) or at 820° C. (comparative embodiment) for 60 minutes, and then aging treatment and nitriding treatment were carried out under the same conditions. Obtained steel strips are subjected to bending fatigue test. The steel strips did not subject to a shot-peening. The bending fatigue test was carried out by repeating under the conditions of amplitude stress of 35 kgf/mm$^2$ and the maximum stress of 165 to 185 kgf/mm$^2$ until the steel strip is broken. The results are shown in FIG. 6. As is obvious from FIG. 6, the conventional steel strip which was solution-heated at 820° C. was broken at $8.4\times10^4$ times under the maximum stress of 165 kgf/mm$^2$. In contrast, the steel strip according to the present invention which was solution-heated at 780° C. was broken at $6.7\times10^6$ times under the maximum stress of 184 kgf/mm$^2$, and even a repetition of $10^8$ times could not break it when the maximum stress was 168 kgf/mm$^2$ or less. Accordingly, it was found that the solution heat treatment controlled at a temperature in the range of 750 to 800° C. for 60 minutes or more, can retain the compressive residual stress caused during the cold rolling which disappears in the case of use the conventional solution heat treatment, and thereby a steel strip having high fatigue strength can be produced.

Though the above description explained about the embodiment using cold rolling, the similar effects can be obtained even if other cold plastic workings such as cold drawing are used. Therefore, according to the present invention, the marageing steel can be homogenized in its material without removing compressive residual stress given during the cold plastic working, by cold-plastic-working marageing steel to form a predetermined dimension; solution-heating at a temperature in a range of 750 to 800° C. for 60 minutes or more; and aging, and thereby a steel material having a high fatigue strength can be rapidly produced.

What is claimed is:

1. A steel material production method comprising:

cold-plastic-working marageing steel to form a predetermined dimension;

solution-heating at a temperature in a range of 750 to 780° C. for 60 minutes or more; and aging.

2. A steel material production method according to claim 1 further comprising nitriding after the aging.

3. A steel material production method according to claim 1, wherein the solution heated marageing steel has a concentration ratio of Ti dissolved in the vicinity of a surface thereof to an averaged dissolved Ti including the inside thereof of 0.9 or more.

4. A steel material production method according to claim 1, wherein the aging is carried out at a temperature in the range of 450 to 500° C. for 30 to 120 minutes.

5. A steel material production method according to claim 2, wherein the nitriding is carried out in a nitrogen gas atmosphere at a temperature in the range of 440 to 480° C. for 30 to 120 minutes.

6. A steel material production method according to claim 1, wherein the solution heating is carried out in a vacuum or in a reductive atmosphere of hydrogen gas.

7. A steel material production method comprising:

cold-plastic-working marageing steel to form a predetermined dimension;

solution-heating at a temperature T, where 750° C.≦T<800° C., for 60 minutes or more; and aging.

8. A steel material production method according to claim 7 further comprising nitriding after the aging.

9. A steel material production method according to claim 7, wherein the solution heated marageing steel has a concentration ratio of Ti dissolved in the vicinity of a surface thereof to an averaged dissolved Ti including the inside thereof of 0.9 or more.

10. A steel material production method according to claim 7, wherein the aging is carried out at a temperature in the range of 450 to 500° C. for 30 to 120 minutes.

11. A steel material production method according to claim 8, wherein the nitriding is carried out in a nitrogen gas atmosphere at a temperature in the range of 440 to 480° C. for 30 to 120 minutes.

12. A steel material production method according to claim 7, wherein the solution heating is carried out in a vacuum or in a reductive atmosphere of hydrogen gas.

* * * * *